United States Patent [101]

du Pré et al.

[11] 4,052,854

[45] Oct. 11, 1977

[54] HEAT TRANSFER INTERFACE BETWEEN A HIGH TEMPERATURE HEAT SOURCE AND A HEAT SINK

[75] Inventors: Frits K. du Pré; Hendrik A. Jaspers, both of Ossining, N.Y.

[73] Assignee: North American Philips Corporation, New York, N.Y.

[21] Appl. No.: 490,725

[22] Filed: July 22, 1974

[51] Int. Cl.[2] ..... F02G 1/04; F28D 13/00; F28F 13/00

[52] U.S. Cl. ..... 60/524; 165/104 S; 165/185

[58] Field of Search ..... 60/517, 524; 165/70, 165/105, 185, 104

[56] References Cited

U.S. PATENT DOCUMENTS

| | | | |
|---|---|---|---|
| 2,431,153 | 11/1947 | White | 165/105 X |
| 3,270,802 | 9/1966 | Lindberg | 165/96 X |
| 3,403,075 | 9/1968 | Fiebelmann | 165/105 X |
| 3,613,773 | 10/1971 | Hall | 165/105 X |
| 3,702,533 | 11/1972 | Dirae et al. | 60/524 |
| 3,823,305 | 7/1974 | Schroder | 165/96 X |

*Primary Examiner*—Allen M. Ostrager
*Attorney, Agent, or Firm*—David R. Treacy; Frank R. Trifari

[57] ABSTRACT

A heat-transfer interface between and separating a high temperature heat source and a heat sink is formed by the adjacent walls of the heat source and heat sink with a thin gap between these walls and helium gas sealed in the gap, the walls preferably defining concentric hemispheres; this interface being particularly feasible as separable walls of the heater portion of a Stirling engine and a heat source.

7 Claims, 7 Drawing Figures

HEAT TRANSFER INTERFACE BETWEEN A HIGH TEMPERATURE HEAT SOURCE AND A HEAT SINK

BACKGROUND OF THE INVENTION

The invention concerns a heat transfer wall or interface between a high temperature heat source and an object to be heated such as the heater portion of a Stirling engine or a heat pipe operable with the Stirling heater. As is well-known, a temperature drop will occur across a heat transfer wall between a heat source and heat sink. Where the heat source involves combustion gases or other hot or potentially contaminating fluids from chemical or nuclear reactions, such heat source systems must be maintained separate from heater pipes that receive the heat from these fluids, and one known solution for this situation is a heat-transfer wall.

In seeking high thermal efficiency one design approach to this problem utilizes a single wall, i.e. common partition wall separating the heat source and heat sink systems, to minimize temperature drop and heat loss. The inherent problem in such design is that the two systems are not independent and separable from each other, because they are either permanently combined into one complex system due to their common wall, or there must be a complete dismantling of one system in order to get to the other system. Another design approach would be to have two independent chambers or containers, with one wall of each chamber placed close together or in contact, thus requiring heat transfer across both walls. The obvious disadvantages here are numerous: first there is temperature drop and heat loss through two walls as opposed to one; second there is further temperature drop through the gap between the two walls if such gap occurs; and third, if the two walls are in contact in a high temperature environment, over a period of time the walls may become joined together by various chemical and/or metalurgical reactions, rendering it difficult to separate them during dismantling.

In the particular situation of a Stirling engine which requires a heat input at temperature in the range of 1500° F, to its sodium heat pipe from a heat source such as chemical combustion using lithium sulfide ($LiSF_6$) or a nuclear reactor, it is critical that the chemical substances be securely maintained within the heat source chamber. If a wall of this chamber is a common wall for the engine heater, and heat source, the assembly of either will be greatly complicated. The intermediate source could well be a sodium heat pipe separated from the chemical reactor by a single metal wall also with the same problems mentioned above.

Thus, the problem faced was to provide an interface between a heat source and the engine heater which would have the highest possible efficiency and heat transfer properties, and thus the lowest temperature drop across the interface, but which would also permit the two components to be easily and fully separated from each other while leaving each intact. The use of two such separate components with their own walls placed closely adjacent led to the problems discussed above namely, the walls becoming bound to each other during the long heat transfer, and heat losses through the two walls and the gap between them, and finally if the walls were placed in contact, different rates of expansion would cause various undesirable stress situations of one wall against the other.

This invention concerns a heat transfer wall or interface between a high temperature heat source and an object to be heated such as the heater portion or heat pipe of a Stirling engine. For such engines common heat sources include combustion gases, or other hot or potentially contaminating fluids from chemical or nuclear reactions. In these situations a heat transfer wall or interface is provided to maintain the heat source system separated from heater pipes of the engine while allowing heat transfer through such wall. The rate of heat flow through and the temperature drop across such walls are parameters of concern in these composite systems. In the case of a Stirling engine, heat transferred through the interface wall is absorbed in fluid medium of a heat pipe and transported by this medium to heater pipes of the engine. Where the interface comprises a single wall of good heat conductivity, the temperature drop, $\Delta T$, and rate of heat transfer will be optimized; however the severe disadvantage is that the interface is a common wall of two closed chambers. Separation of one chamber with the wall from the other, leaves the other chamber open and unsealed. In effect the two systems are not separable without dismantling at least one, and breaking the gas seal.

A contrary approach requires two independent chambers, having closely adjacent or touching walls. Here the heat transfer efficiency is greatly reduced by the cumulative temperature drops across both walls plus across the gap between walls. Use of either of the above structural arrangements substantially compromises benefits of the other. The new invention does in fact combine structural advantages of two separate chambers while approaching the thermodynamic advantages of a single wall.

SUMMARY OF THE NEW INVENTION

The new invention comprises a method and structure of interfacing a heat source with the heater of an engine by using as the interface two separate walls respectively of the heat source and heat recipient, i.e. the Stirling engine heater, and the gap maintained between the walls which gap contains helium gas. A first of the two walls defines part of the heat source chamber which may contain a heat-producing fluid, as $LiSF_6$; the second of the two walls defines part of the heat recipient, which is in operation, a heat pipe containing a second heat-transfer medium as sodium. Preferably these two adjacent walls of the two separate chambers are formed as concentric hemispheres or portions thereof or perhaps cylinders. Means are provided for releasably joining together the mutual peripheries to define between them a sealed space for containing helium gas. Since the two walls are readily dismantlable, the heat source and the heat pipe portion of the engine's heater are independent and are easily separated, with the only result being a loss of a small quantity of helium in the interface space or gap.

At temperatures in the range of 1500° F for Stirling engine operation, helium has a relatively high coefficient of heat conductivity; consequently a gap containing helium in the heat transfer interface will not seriously reduce heat transmission efficiency. However the helium presence must be maintained, as opposed to any other gas or air at the temperatures of operation. It has been known that the rate of expansion is greater of the wall which is hotter namely, the inner wall of the heat source of the concentric hemispherical walls; thus when the apparatus is in operation the gap will tend to be reduced as temperature rises. With known requirements for the temperature of the heat source and the temperature to be achieved at the engine heater, the gap thickness and the metal defining the gap boundaries can be designed such that the gap may vary but will not be closed during the rise in temperature to operating temperature.

DESCRIPTION OF THE PREFERRED EMBODIMENT

Figure 1:
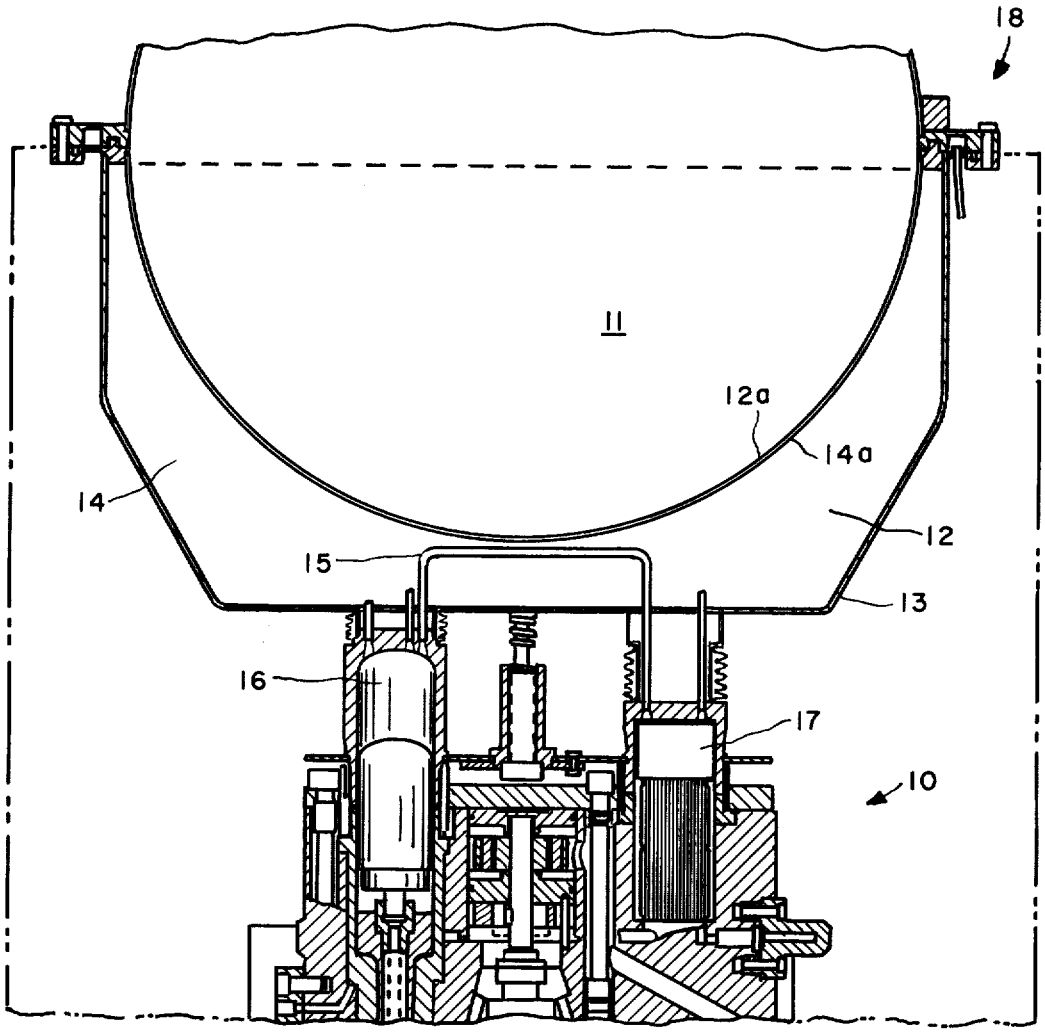
FIG. 1 is an elevation view in section of the new invention showing portions of a Stirling engine and a heat source in thermal communication through a separable double-wall and helium interface.

FIG. 1 shows in combination a Stirling engine 10, a reactor heat source 11, and a heat transfer interface 12 between the engine and heat source. The general structure and operation of Stirling engines is known from numerous prior art publications such as U.S. Pat. Nos. 2,657,552, 2,867,973 2,828,601, *Philips Technical Review*, Vol. 31, No. 5/6 pp. 168–185, 1970 by R. J. Meijer, and *Science Journal*, Vol. 5A, No. 2, pp. 31–37, August 1969 by R. J. Meijer. The portion of a Stirling engine most relevant to this invention is the heater 13 comprising heat pipe 14 and heater tubes 15 which extend from expansion space 16 into the heat pipe 14 and thence to regenerator 17. The heat source 11 may be a nuclear reactor or a burner with combustion gases, or a chamber for chemical combustion of lithium sulfide ($LiSF_6$). The object of course is to transfer heat from this source to the heater tubes 15 with a maximum of efficiency and minimum of temperature drop across the interface 12, which interface is necessary to maintain separate the heat transfer fluid mediums of the heat source and the heat pipe.

Figure 2:
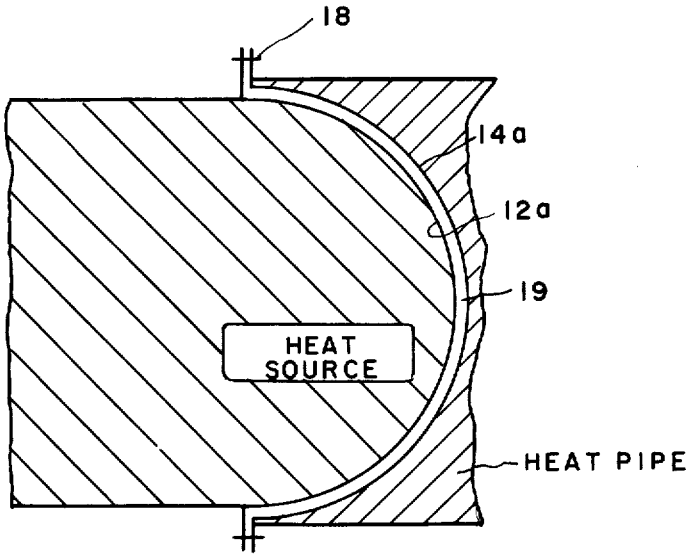
FIG. 2 is a fragmentary schematic view of the interface and adjacent heat source and Stirling engine of FIG. 1.
Figure 3:
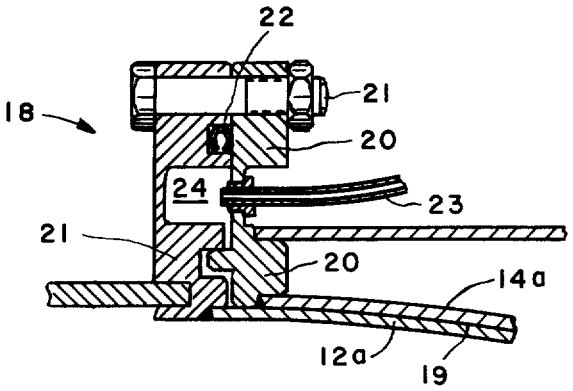
FIG. 3 is an enlarged view in section of the bolt connection in FIGS. 1 and 2.

A feature of the present invention is the construction of the interface to comprise two walls separated by a gap, which gap is filled with helium gas. Wall 14a defines one boundary of the heat pipe 14 in FIG. 1, while wall 12a defines the adjacent boundary of the reactor heat source 11. These two walls are formed as concentric hemispheres at least partially for the reason that such geometry provides a very strong structure for the volume of space occupied; because of this considerable strength, walls can be designed which are very thin, and across which the $\Delta T$ is low. These two walls are joined along their perimeter with bolt and flange connections 18 shown in both FIGS. 1 and 2 and 3. The nature of the gap 19 shown most clearly in FIG. 2 between walls 14a and 12a will be discussed in later paragraphs, however, FIG. 3 demonstrates how helium is introduced and maintained in this gap. Wall 14a terminates in flange 20, and wall 12a terminates in corresponding flange 21, both of which flanges have corresponding apertures for receiving bolt 21 which joins them together securely.

Helium gas is supplied from a source through inlet tube 23 to space 24 which leads to the gap 19, where the helium is maintained during operation. A metal seal 22 is added between the two flanges for further security against escape of the gas, but in case of leakage, additional helium is supplied through tube 23 either from a source of helium used to supply the Stirling engine or from an independent source. Because of the high temperatures at which this apparatus operates, namely in the vicinity of 1500° F, it is necessary for seal 22 to be metal as opposed to rubber or other synthetic.

Figure 4:
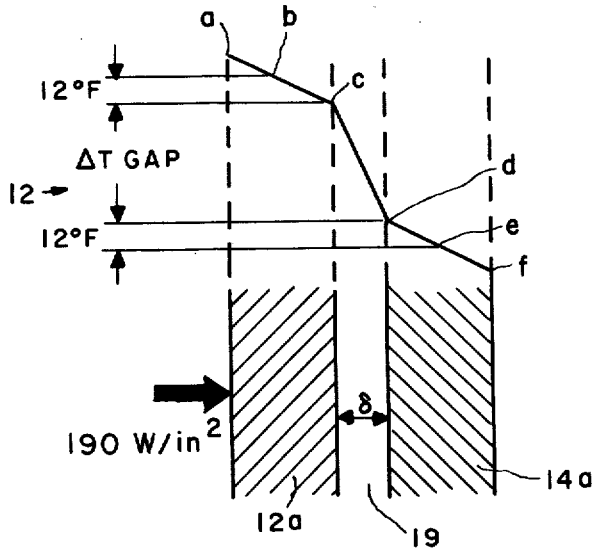
FIG. 4 is a schematic diagram showing a temperature differential across the adjacent heat source and heat pipe walls and helium gap between these walls.
Figure 5:
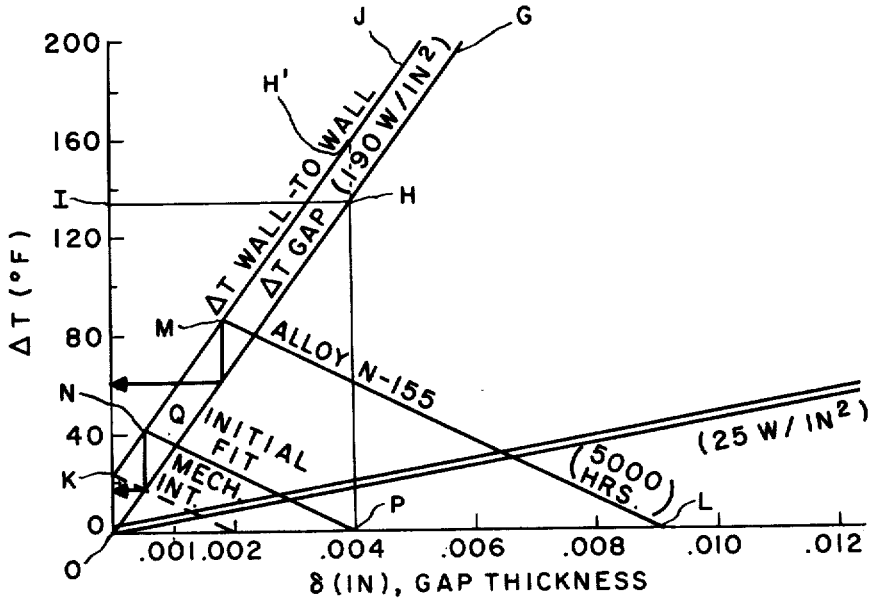
FIG. 5 is a plot of gap width, $\delta$ versus $\Delta T$ (° C) for the diagram of FIG. 4.

FIG. 4 shows a schematic representation of the concentric hemispherical walls 12a and 14a, defining between them gap 19 which has thickness, $\delta$; FIG. 5 shows a schematic diagram corresponding to FIG. 4. Points *a, b, c, d, e, f* in FIG. 4 show the temperature drop through wall 12a, then through or across the gap 19, and then through wall 14a. This particular curve of line *a–f* was determined for a quantity of heat, 190 watts per square inch (W/in²), transferred across these walls, with an assumption that the walls are made of N-155 metal, that the gap contains helium, that the temperature of the heat source is known and will not exceed 1550° F, and finally that the temperature desired for wall 14a will be 1437° F. In this particular case $\Delta T$ through wall 12a from *a* to *b* is 24° F., and the same $\Delta T$ is true from *d* to *f* through wall 14a. $\Delta T$ of the gap will vary depending on the thickness $\delta$ of this gap.

FIG. 5 shows the heat transfer parameters of this interface with respect to variations in the thickness, $\delta$, of the gap, and variations in the quantity of heat transferred through or across the gap. In this chart the abscissa indicates the thickness of the gap, $\delta$ in inches, and the ordinate indicates the temperature difference, $\Delta T$, in ° F. Line OG indicates $\Delta T$ across the gap filled with helium gas for a heat flux of 190 watts per square inch across said gap; accordingly, a line drawn from 0.004 on the abscissa upward to point H on line OG and then horizontally to point I on the ordinate, indicates that with a gap of 0.004 inches the $\Delta T$ across the gap will be approximately 130° F. With smaller gap thicknesses the $\Delta T$ across the gap will be correspondingly smaller. Line JK indicates the total $\Delta T$ across both walls and including the gap. Thus, if a line from 0.004 on the abscissa is extended to H to H' it is indicated that $\Delta T$ across both walls and the gap for a gap of 0.004 inches, would be approximately 150° F. Assuming the interface wall material is alloy N-155, which has a thermal conductivity, $\lambda$, at 1500° F of 0.325 W/in° F, and if this wall has thickness of 0.040 in., then the temperature drop across each wall, for a heat flux of 190 watts per square inch would be $\Delta T$ (for one wall)=

$$\frac{\frac{(190\ W)}{(in.)}\ (0.040\ in)}{\frac{(.325\ W)}{(in.)\ (^\circ F)}} = 23.4^\circ\ F, \text{ which}$$

corresponds to the vertical distance H–H' in FIG. 5.

Line L–M gives the relationship between gap width and $\Delta T$ across the gap due to thermal expansion of the two metal hemispheres; Line LM represents the gap established by two walls of alloy N-155. The gap is established at 0.009 inches on the abscissa, when the apparatus is inoperative and ΔT across the interface is zero. As ΔT increases, the gap decreases; accordingly at M on Line LM, ΔT is approximately 90° F and the gap has been diminished to 0.002 inches. This description of interface structure is only true when the smaller and internal hemisphere of the concentric walls is the hotter one bounding the heat source.

Since it is highly desirable that the gap be maintained and that the walls do not touch even at high temperatures, the design of the structure can be calculated to avoid contact. It is also a design feature that the gap be substantial at room temperature to facilitate assembly and disassembly, and that this gap diminish during high temperature operation to reduce ΔT thereacross, while ensuring that the gap walls never contact each other. In this particular apparatus the reactor wall 12*a* should not exceed a temperature of 1500° F, and the tube temperature of wall 14*a* should be maintained at 1437° F. Since the temperature drops across each wall, each shown to be 24° F. for a heat transfer of 190 watts per square inch, that leaves a ΔT across the gap of a maximum of 61° F. If the ΔT is greater, then the tube temperature would be too low, and if the ΔT is less, then the reactor wall might become too hot. If the gap became closed then there could be thermal interface loading on the walls which is undesirable, and furthermore there would be possible difficulties in disassembling the parts after they were cooled. FIG. 5 shows that if the gap, δ at room temperature is kept between 0.002 and 0.009, no contact will occur at the high temperatures for the given heat flux arrangement, and the temperature drop across the gap will always be less than 61° F. Further explanation of this FIG. 5 chart is as follows: if the initial gap is chosen as 0.004; then from point P on the abscissa to point N is an expansion line which crosses line OG at point Q, which corresponds, via a horizontal line to the ordinate, to a ΔT of about 38° F; point Q also corresponds, via a vertical line to the ordinate, to a gap width diminished to about 0.001 inches. However, since we have decided that ΔT across the two walls should be about 61°,then selecting 61° F on the ordinate and moving across to the ΔT gap line OG, and moving further down to the abscissa, we find that the gap would be 0.002 inches. This is why we set the range of the gap to be from 0.002 to 0.009.

Figures 6, 7:
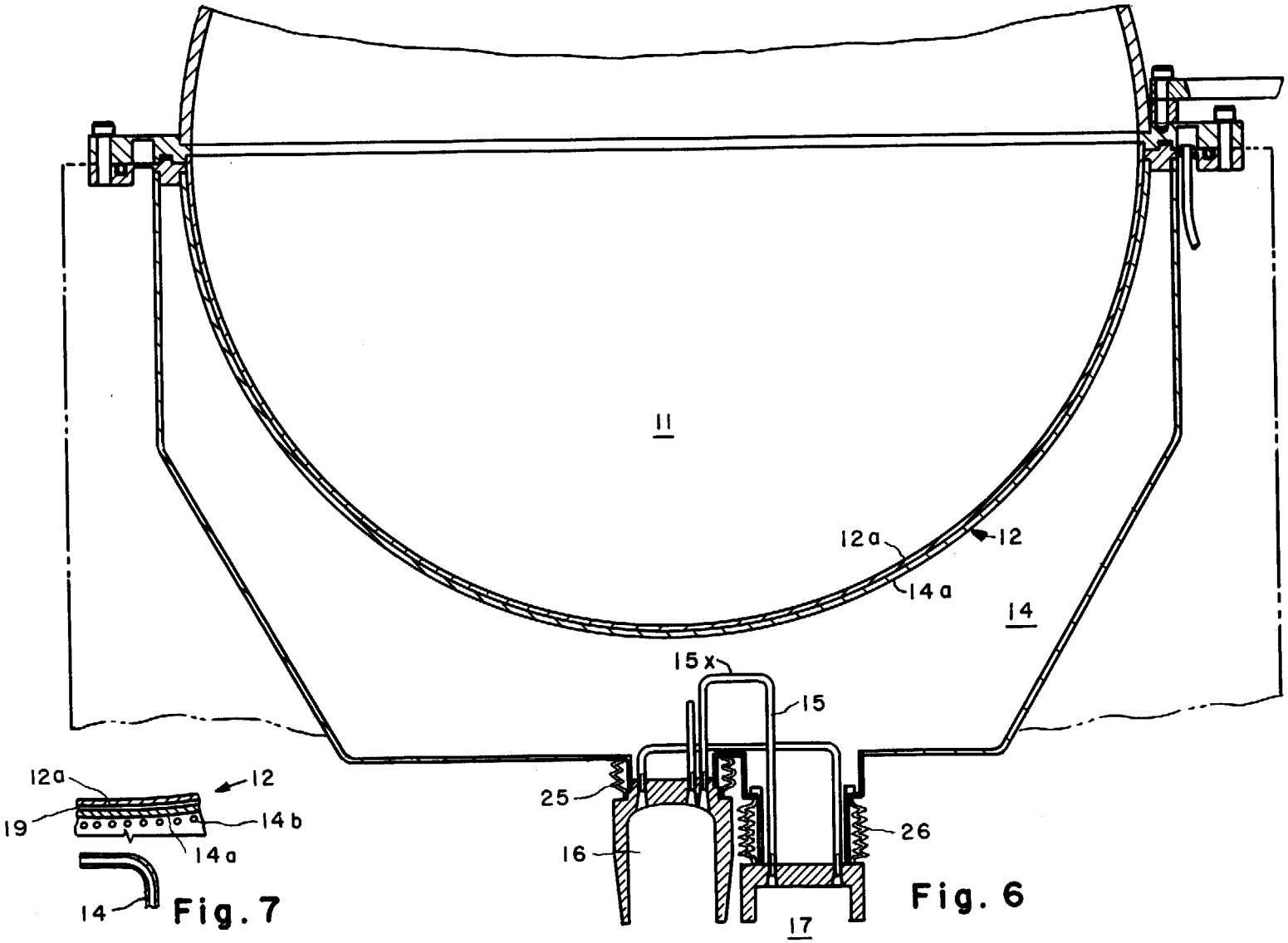
FIG. 6 is a fragmentary view of the invention in section showing detail of the connection of the heat pipe and heater tubes of the engine.
FIG. 7 is a fragmentary, enlarged view of the interface and heater tube of FIG. 6.

FIG. 6 shows greater detail in the connection of the heater part of the engine to the heat pipe and interface. In this figure, heater pipe 15 is shown extending from the expansion space to the regenerator 17 and having its mid-portion 15*x* traversing the heat pipe area 14. FIG. 7 shows in greater detail the association of the interface 12 with the heater tube 15. The inside surface of reactor wall 12*a* has temperature 1507° F and the exposed surface of the heat pipe wall 14*a* has a temperature of 1465° F, which results in a total ΔT of 42° F, when use of this material as interface walls is begun before the effects thereon of creep during a 5000 hour life period. At the end of the 5000 hours, line L-H determines the ΔT across the gap, then 0.004 inches wide. Adjacent the heat pipe wall are wick elements 14*b* which operate as essential elements of the heat pipe.

In FIG. 6 it is shown that the connection of the heat pipe with components of the engine comprises a semi-rigid or flexible coupling means 25 formed as a bellows connecting the cylinder with the heat pipe, and 26 another bellows connecting the regenerator with the heat pipe. Because of the substantial variations in dimension and geometry due to large heat transfer and temperature changes, these flexible couplings allow for minor mis-alignment without damage to the components or interface with their operation.

We claim:

1. A Stirling engine comprising a heat source, working gas for the engine, a heater part in which working gas for the engine is heated, and a heat transfer interface, wherein the interface comprises a pair of adjacent and closely spaced walls formed as generally adjacent flanged peripheries, metallic means for sealing said flanged peripheries together while defining a gap in the range of 0.002 to 0.009 inches between said hemispheric walls, a quantity of gas sealed within said gap, and means for releasably securing together said flanged peripheries to seal said gap while maintaining said spacing between said walls, and the inner one of said concentric walls is a boundary wall of said heat source, and the other of said walls is a boundary wall of said heater part.

2. A Stirling engine as claimed in claim 1 wherein said heater part is a heat pipe, and said other of said walls is a heat-receiving wall of the heat pipe.

3. A Stirling engine as claimed in claim 2 wherein said quantity of gas is a quantity of helium.

4. A heat transfer device comprising a heat source, a heater part to which heat is to be transferred, and an interface, wherein the interface comprises a pair of adjacent and closely spaced walls formed as generally adjacent concentric hemispheres having adjacent peripheries which are sealable together while defining a gap between said adjacent walls, a quantity of gas sealed within said gap, and means for releasably securing together said peripheries to seal said gap while maintaining said gap in the range of 0.002 to 0.009, and one of said walls is a boundary wall of said heat source, and the other of said walls is a boundary wall of said heater part.

5. A heat transfer device comprising a heat source, a heater part to which heat is to be transferred, and an interface, wherein the interface comprises a pair of adjacent and closely spaced walls formed as generally adjacent concentric hemispheres having adjacent flanged peripheries, metallic means for sealing said flanged peripheries together while defining a gap between said hemispheric walls, a quantity of gas sealed within said gap, and means for releasably securing together said flanged peripheries to seal said gap while maintaining said close spacing between said walls, and one of said walls is a boundary wall of said heat source, and the other of said walls is a boundary wall of said heater part.

6. A heat transfer interface as claimed in claim 5 wherein said quantity of gas consists of a gas having a relatively high heat conduction coefficient, and a low diffusion through metal coefficient.

7. A heat transfer interface operable between a heat source and a heat sink, comprising a pair of adjacent walls defining between them a space, means for releasably sealing the adjacent peripheries of said walls to close said space, means for introducing a gas into said space, said gap having a width from 0.002 to 0.009 inches.

* * * * *